US009962716B2

(12) United States Patent
Ballhause et al.

(10) Patent No.: US 9,962,716 B2
(45) Date of Patent: May 8, 2018

(54) ADAPTER FOR A SAMPLE CONTAINER OF A CENTRIFUGE, ADAPTER GROUP AND CENTRIFUGING SYSTEM

(71) Applicant: Thermo Electron LED GmbH, Langenselbold (DE)

(72) Inventors: Norman Ballhause, Windhausen (DE); Mike Armbrecht, Einbeck-Stroit (DE)

(73) Assignee: Thermo Electron LED GmbH, Langenselbold (DE)

( * ) Notice: Subject to any disclaimer, the term of this patent is extended or adjusted under 35 U.S.C. 154(b) by 222 days.

(21) Appl. No.: 14/731,661

(22) Filed: Jun. 5, 2015

(65) Prior Publication Data

US 2015/0352565 A1 Dec. 10, 2015

(30) Foreign Application Priority Data

Jun. 6, 2014 (DE) ..... 10 2014 008 445

(51) Int. Cl.
*B04B 5/04* (2006.01)

(52) U.S. Cl.
CPC .... *B04B 5/0414* (2013.01); *B04B 2005/0435* (2013.01)

(58) Field of Classification Search
CPC ..... B04B 5/0414; B04B 5/04; B04B 5/0407; B04B 5/0421; B04B 5/0428; B04B 2005/0435

(Continued)

(56) References Cited

U.S. PATENT DOCUMENTS

2004/0209755 A1* 10/2004 Moore ..... B04B 5/0414 494/20
2006/0144803 A1* 7/2006 Eberle ..... A61M 1/029 210/787

(Continued)

FOREIGN PATENT DOCUMENTS

DE 102004056620 A1 4/2006
DE 102012013641 A1 * 1/2014 ..... B04B 5/0414
GB 2518323 A * 3/2015 ..... B04B 5/0414

*Primary Examiner* — Walter D Griffin
*Assistant Examiner* — Shirley S Liu
(74) *Attorney, Agent, or Firm* — Wood Herron & Evans LLP

(57) ABSTRACT

Adapter for inserting a sample container in a centrifuge bucket, comprising a bucket-like base body, which delimits a cavity for accommodating the sample container and has a bottom region and an adjoining side wall region, the top edge of which defines an opening edge of the cavity, and an insertion opening, through which the sample container can be inserted in the cavity and which is delimited by the opening edge, at least one separation joint being present in the side wall region of the base body, which separation joint extends from the opening edge in the direction towards the bottom region and which allows for expanding the side wall region from a starting position (P1) to an expanded position (P2) by applying a force in such a way that the opening edge has a larger circumference as compared to the starting position (P1). The side wall area has two edge regions separated from each other by the separation joint, which at least in the starting position (P1) lie one above the other radially and overlap in the circumferential direction (U), thus forming an overlap region.

18 Claims, 3 Drawing Sheets

(58) Field of Classification Search
USPC ..... 494/16, 20, 21
See application file for complete search history.

(56) References Cited

U.S. PATENT DOCUMENTS

2012/0328490 A1* 12/2012 Loehn ..... B01L 3/5021
422/550
2013/0239592 A1* 9/2013 Lofy ..... B60N 3/104
62/3.61

* cited by examiner

ADAPTER FOR A SAMPLE CONTAINER OF A CENTRIFUGE, ADAPTER GROUP AND CENTRIFUGING SYSTEM

CROSS-REFERENCE TO RELATED APPLICATIONS

The present application claims priority under 35 U.S.C. § 119 of German Patent Application No. 10 2014 008 445.0, filed Jun. 6, 2014, the disclosure of which is hereby incorporated herein by reference in its entirety.

FIELD OF THE INVENTION

The present invention relates to an adapter for a sample container of a centrifuge such as, for example, blood bags, or other containers that are used in a centrifuge for accommodating and separating samples.

BACKGROUND OF THE INVENTION

In a centrifuge, substance mixtures are separated by implementation of high acceleration forces. To this end, the substance mixture is placed in a sample container, which is then driven so as to rotate in such a manner that centrifugal forces occur within the sample container to cause separating processes to take place. By this means, for instance, individual liquids may be separated from each other or solid particles from a liquid. On account of the high acceleration values, high forces act on the sample container and its contents so that sample containers must show a high degree of mechanical stability or must be stabilized.

There are various types of sample containers, for which reason adapters are used to fit the different geometries of sample containers to a centrifuge bucket. The sample containers are accommodated in the adapter and the adapter is inserted in a centrifuge bucket. The latter, in turn, is mounted on a centrifuge rotor, which is driven so as to rotate during a centrifuging operation.

It is further desirable for the walls of the sample containers used for the accommodation of samples to be as thin as possible for reasons of weight and the reduction of costs. This, however, results in a loss of stability of the sample container—often to such an extent that they are no longer self-supporting. The same problem occurs with respect to sample containers designed as bags or bag system as used, for example, for centrifuging blood. In the case of such sample containers, the adapters will also serve to support the containers and to maintain their shape.

Furthermore, increasingly larger sample containers are being used for the purpose of achieving more efficient centrifugation. Every centrifuging operation is set to a predetermined time limit, so that sample containers of the largest possible capacity are used to save batch time and reduce overall costs. Due to the high acceleration forces that occur during centrifugation, however, enormous forces are liberated, which act on both the sample container and on the adapter. As a result, the sample container and the adapter may be deformed to such an extent that they can hardly or not at all be separated from each other. Furthermore, there is the possibility of an increased risk of injury occurring during removal of the sample container, since the sample container and the adapter will have become firmly wedged together to render them less readily separable. There is also the added possibility of the deformed sample container being no longer reusable, which in turn increases the costs of the process of centrifugation. Due to the above risks, sample containers of a larger volume are usually restricted as to acceleration, which, however, is concomitant with a reduction in separation efficiency.

German Patent Application No. DE 10 2012 013 641 A1, which is incorporated herein by reference in its entirety, describes an adapter for sample containers, which has a separation or expansion joint in its side wall. This allows for expansion of the adapter for an easy removal of the sample container, which advantageously facilitates the separation of the adapter and the sample container and reduces the risk of damage to the sample container. Conversely, this also enables centrifuging of sample containers with higher volumes even at high accelerations. However, it has been seen here that during centrifugation of sample containers with more complex geometry or with attachments, such as hoses, the sample container or its attached parts can get entangled in the separation joints of the adapter so that the sample container gets damaged during centrifugation or the removal process becomes difficult. This disadvantageous effect of the separation joints can occur, for instance, while centrifuging blood bag systems, where multiple blood bags with hose connections are centrifuged in packages.

It is, therefore, an object of the present invention to provide an adapter for a sample container, which provides all the benefits of the centrifuge adapter described in German Patent Application No. DE 10 2012 013 641 A1, while, at the same time, reducing the risk of damage occurring to the sample container on account of the separation joints during centrifuging and removing.

SUMMARY OF THE INVENTION

In its broadest aspect, the present invention thus relates to an adapter for insertion of a sample container in a centrifuge bucket, including a bucket-like base body, which delimits a cavity for receiving the sample container, and which comprises a base region and an adjoining side wall region, the top edge of which defines the opening edge of the cavity, and an insertion opening, through which the sample container can be inserted in the cavity and which is delimited by the opening edge. At least one separation joint is present in the side wall region of the base body, which separation joint extends from the opening edge in the direction towards the base region and which allows for the side wall region to be expanded from a starting position to an expanded position by means of an applied force such that the opening edge has a larger circumference compared to the starting position. The side wall region has two edge regions separated from each other by the separation joint, which at least in the starting position are radially superimposed, i.e., lie one above the other in the radial direction, and overlap in the circumferential direction, thus forming an overlap region.

The adapter according to one embodiment of the present invention thus differs from the prior art described in German Patent Application No. DE 10 2012 013 641 A1 with respect to the improved implementation of the separation joints and the overlap region present at least in the starting position. These improvements especially serve the purpose of protecting the sample container during insertion and removal of the sample container from the adapter as well as during centrifugation and to hence prevent damage to the sample container. In terms of shape and structure, the adapter thus basically corresponds to the adapter described in German Patent Application No. DE 10 2012 013 641 A1, however, differing from the latter in that the edge regions of the side wall region of the adapter according to the present invention which are located adjacent to a separation joint lie radially above each other and overlap in the circumferential direction. In case of the adapter described in DE '641, the edge regions of the adapter side walls lie adjacent to each other with their front face edges and are separated from each other in the circumferential direction by the separation joint. In case of the adapter according to the present invention on the other hand, the separation joint lies, as regarded in the radial direction, between the overlapping edge regions, which, as regarded in the circumferential direction of the adapter, represent lateral end regions of the side wall region of the adapter base body. Thus, for instance, when viewing an adapter according to the present invention in the area of the separation joint from inside to outside in the radial direction, the first and the second edge region lie one behind the other and are separated by the separation joint. At least in the starting position, the edge regions are thus slid one above the other in the circumferential direction to such an extent that the front face edges of the edge regions in the overlap region face away from each other.

The overlap region reduces the risk that parts of a sample container (such as a section of a blood bag) or parts connected with the sample container (such as, for example, hoses connecting blood bags within a blood bag system) protrude from the cavity of the adapter to the outside or get entangled, wedged or clamped in the separation joint. This considerably enhances the protection of the sample container against damages during centrifuging as well as during loading and unloading the adapter. Sample containers with high volumes, such as from 100 to 3000 milliliters, with very thin container walls can also be centrifuged without any risk of damage.

In order to even better protect the sample container against damages, the adapter according to the present invention may comprise additional preferred features. For instance, it is expedient that the said edge regions overlap in the starting position not only at one spot, but along at least 50% and preferably completely along the entire longitudinal extension of the separation joint. In this case, the side wall region of the base body is closed towards outside at each point of the separation joint in the circumferential direction. Therefore, there is no longer an open gap in the side wall in the radial direction, into which parts of a sample container may protrude and be damaged as described above.

As already described in German Patent Application No. DE 10 2012 013 641 A1, one separation joint—resulting in two overlapping edge regions—may generally be adequate in the adapter according to the present invention. This is advantageously designed with respect to its course in the side wall region and its extension in such a way that an easy removal and an easy insertion of sample containers in the adapter cavity is possible. Preferably, the separation joint runs from the opening edge down into the base region, that is, one of its ends extends beyond the lower end of the side wall region facing away from the insertion opening. In one embodiment, the adapter according to the present invention comprises more than one separation joint, more preferably two separation joints, which are advantageously arranged on opposite sides of the adapter. It is preferred here to have a respective overlap region with two overlapping side wall edge regions in the area of each of the separation joints, the respective overlap region being present at least in the starting position of the adapter.

However, a risk of damaging the sample container exists not only when the adapter is in the starting position, but also when the adapter is in an expanded position or is brought back from the expanded position to the starting position. To counteract this risk, the edge regions are designed in such a way that they overlap even in the extended position, for example, when loading the adapter, along the longest possible section and preferably over the entire length of the separation joint in the side wall region. Upon expanding the adapter, which is usually done by manually pulling away the side walls, the edge regions are pulled away farther in the area adjacent to the opening edge than in the lower area of the separation joint. In one embodiment of the present invention, therefore, the width of the overlap region in the starting position increases in the circumferential direction over the length or height extension of the separation joint. This results, for instance, in a wedge-shaped overlap region. In this way, the adapter has a side wall area which is closed in the circumferential direction even in the expanded state and thus offers the highest possible protection of the sample container against damages through clamping. If the separation joint extends into the bottom region of the adapter, it is sufficient if the overlap region is present in the side wall region of the adapter. However, it is also possible that the overlap region extends into the bottom region.

It is further expedient if at least in the starting position the distance between the two overlapping edge regions in the radial direction is so small that no parts of the sample container can reach into the overlap region of the edge regions. It is particularly favorable when in the starting position the edge regions directly rest against each other in the radial direction, more preferably, along the entire longitudinal extension of the separation joint.

The risk that a part of the sample container penetrates in the overlap region and thereby gets damaged can be further reduced if the overlapping edge regions are fixed to each other or accommodate each other so as to be movable relative to each other. The fixing can be such that the edge regions are prevented from being pulled apart in the radial direction. Alternatively, or additionally, the adapter can be designed such that an excessive expansion of the opening edge beyond an extent which suffices for a comfortable insertion and removal of the sample container from the cavity of the adapter is prevented. In a preferred design, for instance, one of the two edge regions is implemented so as to have a fork-like shape along a side edge, so that the fork-shaped first edge region can accommodate the second edge region. At least in the starting position, the second edge region then engages in the fork-shaped first edge region. In this manner, the sample container is shielded from the separation joint and at the same time additional stability is provided to the side wall of the adapter in the area of the separation joint. The fork-shaped first edge region, in this case, also acts as a guide for the second edge region during expansion and pushing together of the adapter so that these movements run in a guided manner, which facilitates the handling of the adapter.

To prevent the adapter from being expanded beyond the necessary extent by too strong pulling apart forces, the adapter may comprise a movement restriction device, which prevents an excessive widening, which might cause the edge regions to no longer overlap and thus the sample container to be exposed again to an increased risk of damage. To prevent such an excessive, unintended expansion, it is useful to implement the edges of the edge regions thicker in the described embodiment having fork-shaped first edge regions. More specifically, one or both edges of the fork-shaped first edge region, as well as the edge of the second edge region, which engages in the first edge region, are implemented as thickened, wherein a thickening of partial sections of the respective edges may be sufficient. More preferably, however, these thickened areas extend over the entire length of the edge regions engaging in each other. In this way, the second edge region with its thickened edge is locked in the fork-shaped first edge region. The side wall can then be pulled apart without any large application of force only to the extent that the thickened edge areas strike against each other. This stop position is dimensioned in such a way that the removal and insertion of the sample container is easily possible. At this point, the force needed for an expansion of the adapter beyond this point increases abruptly, which the user notices haptically during manual expansion. The two edge regions are thus prevented from unintendedly being pulled apart, the proper handling of the adapter is noticeably simplified and the sample container is effectively protected.

Apart from protecting the sample container against being damaged in the separation joint, another aspect of the present invention is ensuring the stability of the sample container during centrifugation. As already described in German Patent Application No. DE 10 2012 013 641 A1, the inner geometry of the adapter, i.e., the shape and size of the cavity, is oriented to the outer geometry of the sample container to which the adapter is fitted. The better the basic shape of the adapter is fitted to the sample container, the more stability is provided to the sample container during centrifugation. Further preferred features arise from the fact that a preferred field of application of the present invention is the centrifuging of blood bag systems.

Blood bag systems normally comprise three to four blood bags, which are connected with one another via hoses, as well as filters and/or satellite bags, if needed. One of these blood bags, also known as whole blood bag, is tightly filled at the beginning of centrifuging. The remaining blood bags are normally empty and are for centrifugation purposes packed together with hoses and the whole blood bag to form a blood bag package such that hoses and empty blood bags lie on the same side of the whole blood bag. The packed up blood bag system is normally higher and wider in the area of the whole blood bag than in the area of the hoses and the empty blood bags. For this reason, when centrifuging blood bags, it is preferred that the cross-section of the base body of the adapter and/or the opening edge have a kettle-like profile, which roughly matches the profile of an upright standing blood bag package as regarded in top view. Specifically, the cross-section has at least two side wall sections running in straight lines as well as side wall sections running in curved lines. The straight-lined side wall sections are especially suitable for arranging the separation joint and hence also the overlap region in them, because in this way the adapter can be flapped open or expanded linearly along a flat side wall section. In one embodiment, the cross-section profile corresponds to a trapezoid with rounded angles, hence has four straight-lined side wall sections connected with one another through rounded angles. The blood bag system is, in this case, inserted in the adapter in such a way that the whole blood bag is arranged on the wide side of the trapezoid, while the remaining blood bags and the hoses are arranged towards the narrow side of the trapezoid. Consequently, in the starting position of the adapter, all components of the blood bag system rest tightly against the side wall, which provides an optimal stability. An additional benefit of this basic adapter shape is that the other preferred features, such as the fork-shaped edge regions described above, can also be combined therewith particularly easily. For example, the function of the fork-shaped edge regions as guide elements is supported by the straight-lined side wall sections, which overall facilitates the handling of the adapter.

For stabilizing the sample container, it is also useful to adjust the shape of the bottom region of the adapter to the packed blood bag system. To this end, due to the different height of the whole blood bag and the rest of the blood bag system in the packed state, the adapter is preferably shaped such that a part of the bottom region is beveled as compared to the remaining part of the bottom region and the side wall. This beveled part of the bottom region, more particularly, extends along a flat side wall section and, starting from the remaining straight part of the bottom region, is inclined upward in the direction of the opening edge. When inserting the blood bag system in the adapter, especially the whole blood bag, which is filled at the beginning of the centrifugation, is arranged on the straight bottom region, while the remaining blood bags, hoses and filters, if any, and/or satellite bags are arranged on the beveled bottom region corresponding to their lower height. Because of the inclination of the bottom, these parts of the blood bag system are pressed in the direction of the whole blood bag, the latter thereby in turn being pressed against the adjacent side wall region and hence supported in remaining in an upright standing position.

The base body of the adapter can have a single or multi-component structure. In the latter case, the individual components of the adapter are separated from one another by a continuous separation joint. The individual components are connected with each other to form the complete adapter. The connection is done preferably in the bottom region. It is especially preferred here that the base body is formed from exactly two components. The connection of the two base body components preferably permits a certain measure of play between them, for instance, in the form of a restricted flapping movement of the base body components to one another. A two-component adapter is thus obtained, whose base body components can be flapped apart to a certain extent. As compared to a single-component design of the adapter, in this way, the force needed to expand the adapter to a defined extent may be reduced. Another advantage resides in the easier manufacturing of the single components, which have a less complex shape than the complete adapter. This especially facilitates the production by means of injection molding using a plastic material. Moreover, the material of the base body is less stressed and thus the service life of the adapter is increased, as compared to a single-component design, a lower force acts on the material at the same expansion, which reduces the tendency of the adapter to form bends or breaks upon frequent use. The connection of the base body components can, for example, be shaped as a snap or plug connection. If a beveled bottom region is present, the base body components are connected with one another preferably in the beveled part of the bottom region.

The disassembling of the adapter into components is expediently done such that the components have approximately the same size. In case of two components, the separation joint preferably extends along opposite side wall sections, which are preferably flat. As a result thereof, the overlapping regions move against each other in a scissors-like fashion, without hampering their mutual movement. Consequently, the process of expansion and closing can be controlled very well by the user and occurs guided by the shape of the adapter itself, which overall further improves the handling of the adapter.

As regards the preferred material from which the adapter according to the present invention, and especially its base body are made, reference can be made to German Patent Application No. DE 10 2012 013 641 A1. Accordingly, a plastic material, and especially a plastic material, suitable for injection molding is preferred. As already described in DE '641, in the scope of the present invention too, the adapter can, by corresponding selection of the shape and/or the material, be designed in such a way that the side wall region will automatically return to the starting position upon removal of the force expanding the opening edge. A return to the starting position may also be understood to involve a recoiling to an extent that after recoiling the circumference of the opening edge of the adapter base body in the starting position differs from the original circumference before expansion by a maximum of ±10%, preferably by a maximum of ±5%, more preferably, by not more than ±2% and, very preferably, by a maximum of ±1%. By means of the recoiling force acting on the sample container, the latter is additionally stabilized during centrifuging and kept in position. Furthermore, the recoiling properties of the adapter enable an easier handling, because the adapter does not have to be brought to the starting position manually when needed, but instead this takes place automatically due to the recoiling force of the base body, as long as no counteracting force blocks the recoiling of the adapter.

To ensure these recoiling properties, the base body is preferably of a flexible, more particularly, elastomeric, plastic material, as described in German Patent Application No. DE 10 2012 013 641 A1. This can be basically any suitable plastic material which has the stiffness required to accommodate a sample container disposed in the cavity in the starting position and to keep it stable, but which is sufficiently mechanically flexible in order to be bent into the expanded position for the purpose of removing the sample container and to subsequently recoil to the starting position upon removal of such an expanding force. As described, injection-moldable plastic materials are preferably used, as this method is particularly suitable for the manufacture of the adapter base body. In this regard, elastomeric plastic materials are to be understood to comprise all plastic materials capable of elastic deformation, namely homopolymers, copolymers, and polymer blends, with or without fillers, such as minerals or fibers. This particularly includes thermoplastic elastomers. Specific examples of suitable and preferred plastic materials are polyolefins, more particularly, polypropylenes, or polyamides. Blends or copolymers of such plastics materials may also be used.

The shaping can also be used to produce the recoiling properties of the adapter base body. For example, a curved transition area can be present between the bottom region and the side wall region, with which, especially in case of a separation joint extending into in the bottom region, an increase in tension is achieved in the expanded state and hence a higher recoiling force towards the starting position. Reinforcing ribs may be provided on the exterior surface of the base body for the purpose of stiffening the adapter and, if needed, for increasing the recoiling properties, as already described in German Patent Application No. DE 10 2012 013 641 A1. The reinforcement ribs preferably extend from the side wall region to the bottom region. The ribs can easily be adjusted to the contact surface of the centrifuge bucket and can easily be removed therefrom. Forming a part of the base body, they can also be made of a flexible material, so that they provide a mechanical damping effect. In addition, the reinforcement ribs may serve to define an outer geometry of the adapter in order to enable a better fit between the adapter and the centrifuge bucket, without thereby impairing the shape of the adapter cavity (and hence the fit between the adapter and the sample container placed in the cavity).

In order to remove the adapter and to expand it very easily, at least one protrusion, for example, in the form of a pin, is suitably provided in a top edge region of the base body. This facilitates bending open a side wall region and the removal of the sample container from the adapter cavity. The protrusion may be integrally joined to the base body or connected thereto as a separate piece, the former option being preferred.

For expansion and closing purposes, due to its shape and material selection, the adapter according to the present invention, in particular, dispenses with any additional hinges and fastening means, such as hooks or the like, in order to move the side wall regions separated by the separation joint against each other or to fix them to each other. This facilitates the production and handling considerably.

In another aspect, the present invention relates to an adapter group, in which several adapters according to the present invention, preferably two adapters, are put together, for the purpose of optimal utilization of the space available in a centrifuge bucket. Therefore, in particular, the outer geometry of the adapter group matches the inner geometry of the centrifuge bucket, for example, in that each of the two adapters of an adapter group is formed with respect to its outer geometry in such a way that it is complementary to one half of the inner geometry of the centrifuge bucket. In order to enable an easier handling in general and a coordinated insertion of the adapters in the centrifuge bucket, in particular, the adapters are preferably connected with a connecting element, which is suitably a handle, with which the adapters can be removed from and inserted in the centrifuge bucket very easily.

In a further aspect, the present invention relates to a centrifuging system comprising a sample container, an adapter or an adapter group according to the present invention as well as a centrifuge bucket. At the centrifuge bucket, which accommodates the adapter or the adapter group, means are provided for fastening the centrifuging system to the rotor of a centrifuge. A sample container is accommodated in the adapter or one of the adapters of the adapter group, which sample container is, in particular, a blood bag or a blood bag system. The centrifuging system suitably contains an equal number of sample containers and adapters.

BRIEF DESCRIPTION OF THE DRAWINGS

The present invention is explained in greater detail below with reference to exemplary embodiments. However, the present invention is not restricted to these exemplary embodiments, and other combinations and applications are therefore possible. In the following diagrammatic drawings, in which like parts are identified by like reference numerals.

DETAILED DESCRIPTION OF THE INVENTION

Figure 1:
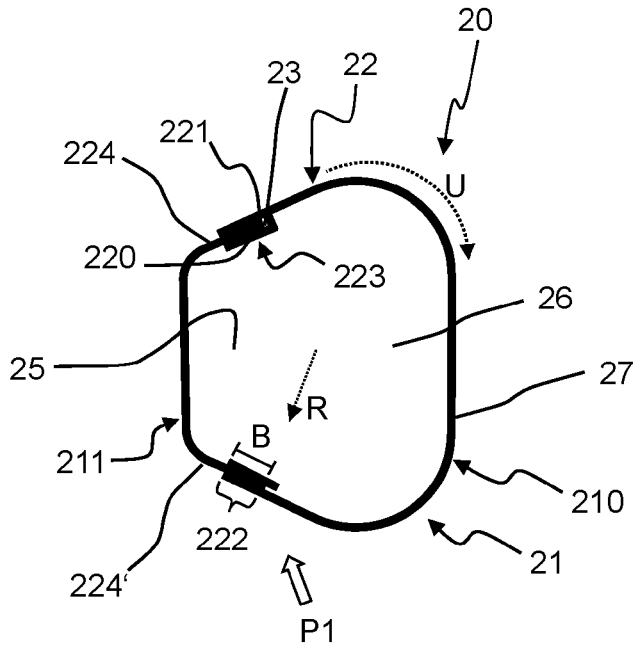
FIG. 1 shows a top view of an exemplary embodiment of an adapter according to the present invention.
Figure 2:
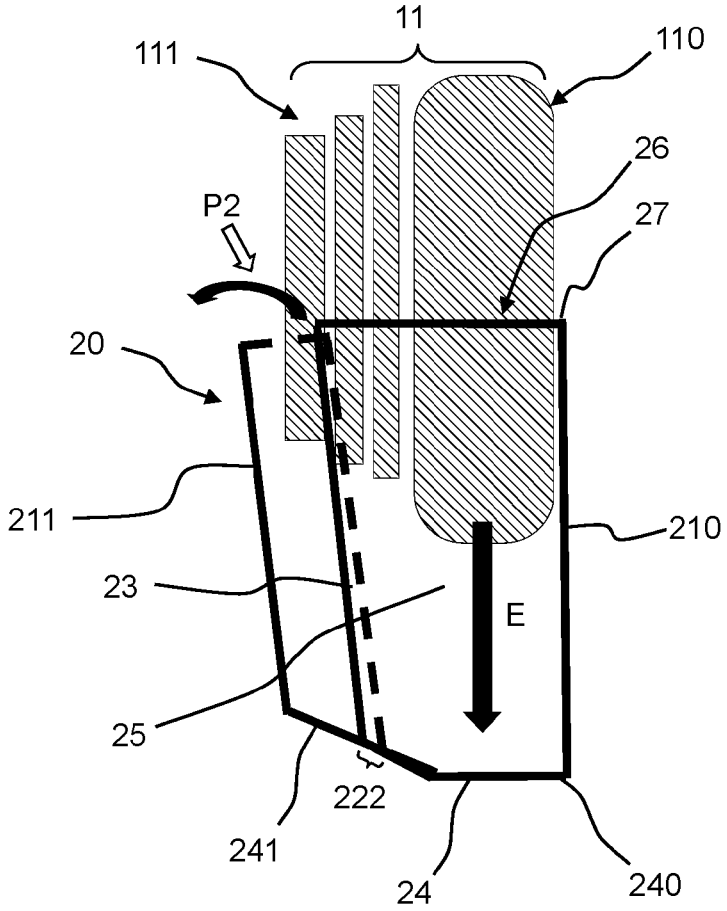
FIG. 2 shows a side view of the adapter from FIG. 1 during the loading process.

FIG. 1 shows an exemplary embodiment of an adapter 20 in top view. The adapter is present in non-expanded starting position P1. It is not loaded, i.e., does not contain any sample container. The shown exemplary embodiment of the adapter 20 is implemented for centrifuging a blood bag system as sample container. FIG. 2 shows the adapter 20 from FIG. 1 in a partially transparent side view during the insertion of a blood bag system 11.

The base body 21 of the adapter 20 is bucket-like and comprises a side wall region 22 and a bottom region 24. These two regions enclose a cavity 25, whose size and shape is implemented such that the blood bag system can be inserted therein in an exactly fitting manner and can be stored safely. The opening edge 27, which forms the top edge of the side wall region 22 and defines the insertion opening 26 through which the blood bag system is inserted in the cavity 25, as well as the cross-section of the side wall region are implemented so as to have a kettle-like shape. As can be seen in FIG. 1, the shape somewhat corresponds to a trapezoid with rounded angles. As shown in FIG. 2 (see arrow E), the blood bag system is inserted with the whole blood bag 110 in the cavity 25 on the wider side of the trapezoid, while the satellite bags and hoses 111 are oriented towards the narrower side. The bottom region 24 adjoining to the side wall region 22 comprises two different sections, namely a straight bottom region 240 as well as a beveled bottom region 241, which, starting from the straight bottom region 240, rises upward towards the opening edge 27. In the loaded state of the adapter 20, in which the blood bag system stands on the bottom region 24, the whole blood bag comes to stand on the straight bottom region 240, while the remaining parts 111, which have a smaller height, are positioned on the beveled part 241 of the bottom region. The parts 111 of the blood bag system are thus pressed against the whole blood bag 110 and, in turn, press the latter against the vertical side wall section shown on the right in FIGS. 1 and 2. As a result of this, the whole blood bag 110 remains stable and upright even during centrifuging.

Figure 3:
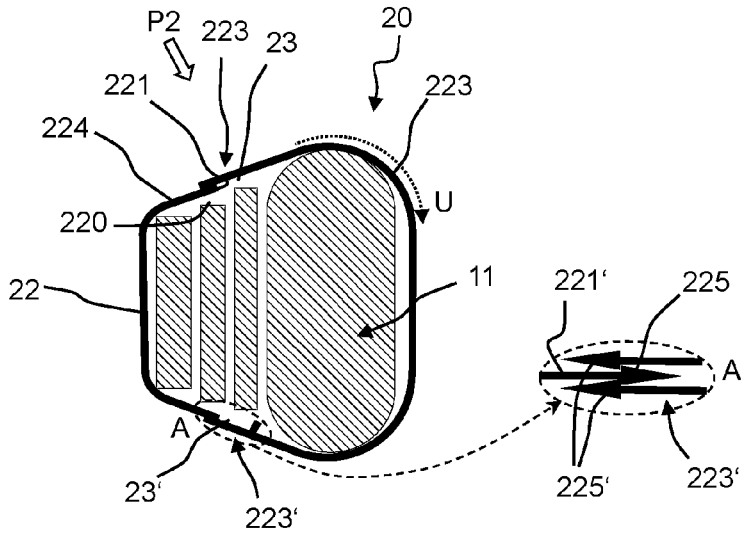
FIG. 3 shows a side view of the loaded adapter from FIG. 2 in expanded position and an enlarged detail view of the overlap region.
Figure 4:
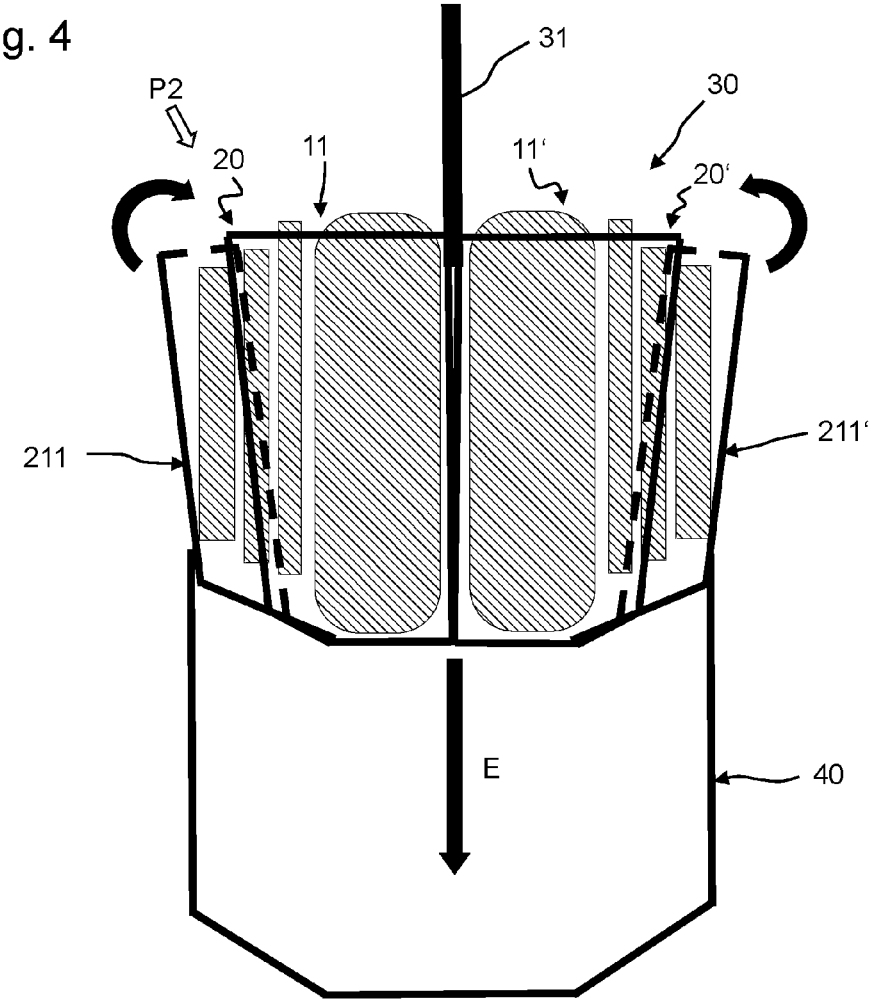
FIG. 4 shows a side view of an adapter group with the adapter from FIG. 2 during insertion in a centrifuge bucket.

To facilitate the insertion and removal of the blood bag system 11, the adapter 20 can be moved from the starting position P1 shown in FIG. 1 to an expanded position P2 (FIGS. 2 to 4). For this purpose, a separation joint is present, which divides the base body 21 into two base body components 210, 211. The separation joint consists of two separation joints 23, 23' which extend from the opening edge 27 along the entire height of the opposite straight side wall sections 224, 224' down to the beveled bottom regions 241 and which unite in the beveled bottom region 241 and hence form one continuous separation joint. The two separate components 210, 211 are fixed to each other in the area of the bottom 24 in such a way that they can be moved away from each other, as indicated by the curved arrow. Upon pulling apart the two base body components 210, 211, the opening edge 27 expands, that is, the insertion opening 26 is enlarged in the expanded position P2 (see FIG. 3) as compared to the starting position (FIG. 1). However, in the expanded position P2, the side wall region 22 of the base body 21 still remains closed in the circumferential direction U. The reason for this is that edge regions 220, 221 projecting over the separation joint 23 are provided in the base body, which lay one above the other in the radial direction R and overlap in the circumferential direction U. The edge regions 220, 221 are formed in such a way that the overlap region 222, on the one hand, extends over the entire height of the side wall region and, on the other, is present in the starting position P1 as well as in the expanded position P2. The overlap of the edge regions 220, 221 is thus big enough, particularly in the area of the opening edge 27, to prevent that a gap arises in the side wall of the base body in a position P2, in which a comfortable removal of the blood bag system 11 from the adapter 20 is possible. In this way, in the starting position P1, as well as in the expanded position P2, a clamping of parts of the blood bag system 11 and hence damage is prevented.

In the present example, one of the edge regions in the overlap region 222 is designed as a fork-shaped region, which accommodates the other edge region 221. This fork-shaped region 23 is formed at least over the entire height of the side wall region 22 and, if needed, also in the bottom region 24. Consequently, the edge regions 220, 221 overlap, on the one hand, in the circumferential direction U, as a result of which the side wall 22 is closed in the circumferential direction U and, on the other hand, also rest against each other in the radial direction R. In combination, these two features particularly effectively prevent the parts of the blood bag system 11 to be centrifuged from getting clamped in the separation joints 23, 23', thus effectively reducing the risk of damage to the blood bag system 11.

FIG. 2 shows a top view of the adapter 20 from FIGS. 1 and 2 in expanded position and with an inserted blood bag system 11. As can be seen, the fork-shaped edge region 223 is wide enough that, in the expanded position P2, the first edge region 221 is still located within the fork-shaped region 223 even at the opening edge 27. The overlap region between the edge regions 220, and in the expanded position P2, still exists over the entire height of the side wall region 22. To prevent the adapter from being expanded to a greater extent than necessary for an easy insertion of the blood bag system 11 and, consequently, the margin areas being pulled apart so far that a gap arises between them in the side wall region, the edges 225, 225' of the edge regions can be thickened. This is shown in the enlarged detail A. The edges of the edge region 221' and of the fork-shaped region 223' have a wedge-shaped cross-section. Upon pushing in the edge region 221', its thickened edge 225 engages behind the thickened edge 225' of the fork-shaped region 223', and the edge regions can now be pulled apart only by applying a high force or after purposely widening the fork-shaped region 223'. The thickening preferably extends over the entire height of the side wall region 22. It is, however, also possible to provide the thickening along the edges only in sections.

After inserting the sample container in the form of a blood bag system 11 in the adapter 20, the latter is placed in a centrifuge bucket, which is then in turn fixed to the rotor of a centrifuge (not shown) in a known manner for centrifuging. FIG. 4 illustrates the insertion of the blood bag system 11 accommodated in the adapter 20 in a centrifuge bucket 40. The components are shown in a partially transparent side view. In one embodiment of the present invention, the centrifuge bucket is designed to accommodate two adapters 20, 20', which together form an adapter group 30 according to the present invention. The two adapters 20, 20' are placed against each other with their high, straight side wall sections and are held together by means of a common handle 31. The handle enables an easy insertion of the adapter group 30 in the direction of the arrow E in the centrifuge bucket. In doing so, the flapped outside wall regions of the components 211 and 211' slide along the inner wall of the centrifuge bucket 40 and are pressed towards the interior in the direction of the curved arrows. The adapters 20, 20' are thus brought back from the expanded position P2 to the starting position P1.

In an alternative embodiment, the adapters 20, 20' may also be formed such that the return from the expanded to the starting position occurs automatically. The adapters, which are normally made of plastic, are made from a plastic material in this case, which recoils automatically to its starting position because of its elastic properties. The recoiling properties can also be enhanced by appropriate shaping of the adapter.

Figure 5A:
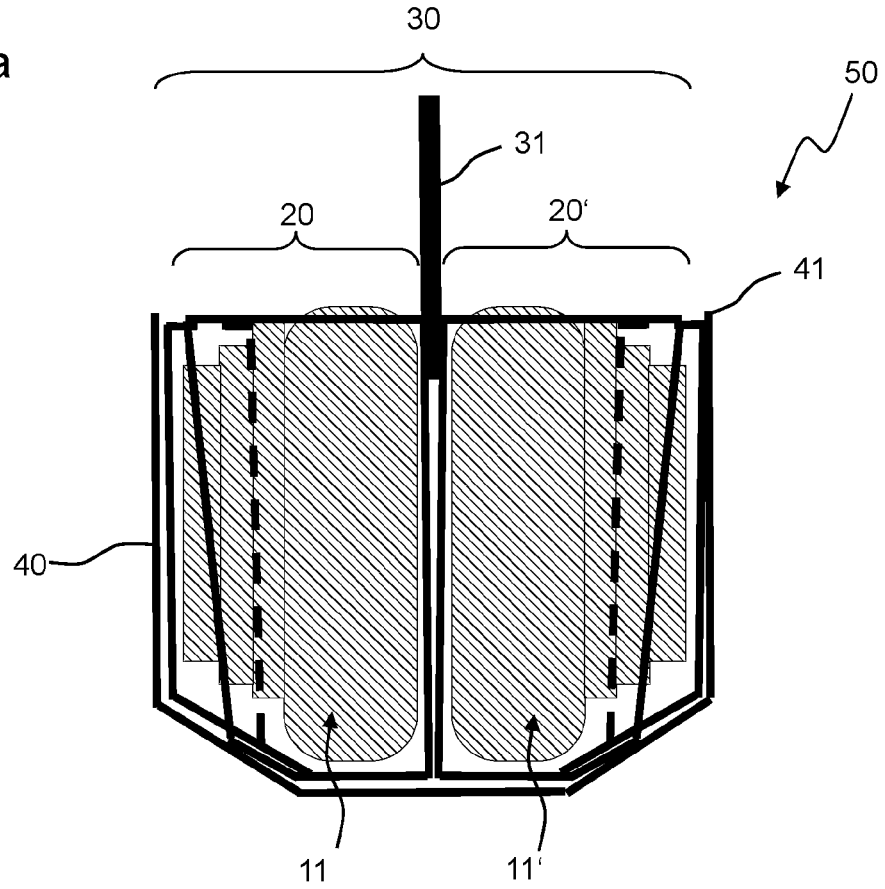
FIG. 5*a* shows a side view of a centrifuging system according to the present invention, comprising the adapter group from FIG. 4.
Figure 5B:
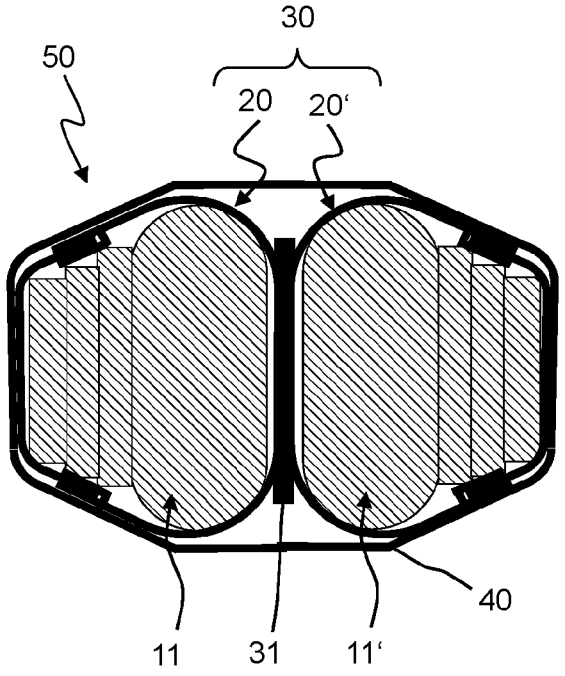
FIG. 5*b* shows a top view of the centrifuging system from FIG. 5*a*.

FIG. 5 shows the arrangement of FIG. 4 with the adapter group now completely inserted in the centrifuge bucket. The centrifuging system 50, according to the present invention, thus obtained is shown in FIG. 5*a* in a partially transparent side view and in FIG. 5*b* in a top view and comprises a centrifuge bucket 40 and an adapter group 30 with two adapters 20, 20' and blood bag systems 11, 11' inserted therein. The adapter group 30 with the blood bag system 11, 11' does not, or only to a minimum extent, protrude beyond the top edge 41 of the centrifuge bucket 40, so that the latter can be sealed with a lid if needed, or be covered by a centrifuge lid, depending on the centrifuge type used. Side wall regions and bottoms of the adapters 20, 20' rest against the inner wall and bottom of the centrifuge bucket 40 over large surface areas and are thereby held in the starting position P1. The blood bag systems are stabilized in an upright position in the adapters 20, 20' and can be centrifuged in this way without collapsing. There is no risk that parts of the blood bag system get caught in gaps of their respective adapter, because adapter surfaces which are closed in the circumferential direction are provided for the blood bag systems. There is thus only a minimum risk of damage to the blood bag system.

While the present invention has been illustrated by description of various embodiments and while those embodiments have been described in considerable detail, it is not the intention of Applicants to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicants' invention.

What is claimed is:

1. An adapter for inserting a sample container in a centrifuge bucket, the adapter comprising:

a bucket-like base body which delimits a cavity for accommodating said sample container and has a bottom region and an adjoining side wall region, a top edge of which defines an opening edge of said cavity, and an insertion opening, through which said sample container can be inserted in said cavity and which is delimited by said opening edge, at least one separation joint in said side wall region of said base body, which separation joint extends from said opening edge in the direction towards said bottom region and allows for expanding said side wall region from a starting position (P1) to an expanded position (P2) by applying a force in such a way that said opening edge has a larger circumference as compared to the starting position (P1), wherein said side wall region has two edge regions separated from each other by said separation joint, which at least in the starting position (P1) lie one behind the other in a radial direction and overlap in a circumferential direction (U), thus forming an overlap region.

2. The adapter according to claim 1, wherein said base body is implemented in such a way that said side wall region automatically recoils to the starting position (P1) upon removal of said force.

3. The adapter according to claim 1, wherein one of said edge regions is implemented as a fork-shaped region and said other edge region engages in said fork-shaped area at least in the starting position (P1).

4. The adapter according to claim 1, wherein edges of said edge regions have a thickness in cross-section that is greater than a thickness in cross-section of said wall region of said base body.

5. The adapter according to claim 1, wherein in the starting position (P1) a width (B) of said overlap region in the circumferential direction (U) increases over the length of said separation joint towards said opening edge.

6. The adapter according to claim 1, wherein said base body is made of a flexible plastic material selected from one of an elastomeric plastic material, a polyolefin, a polyamide, or a plastic material suitable for injection molding.

7. The adapter according to claim 1, wherein said opening edge and/or a cross-section of said base body has a kettle-like profile.

8. The adapter according to claim 1, wherein said bottom region comprises a beveled region which is inclined upward starting from a straight bottom region in the direction of said opening edge.

9. The adapter according to claim 1, wherein said separation joint extends from said opening edge down into said bottom region.

10. The adapter according to claim 1, wherein the adapter has two separation joints which are arranged in opposite side wall sections, each of said side wall sections being flat.

11. The adapter according to claim 1, wherein said base body consists of multiple base body components which are separated from each other by said separation joint.

12. The adapter according to claim 11, wherein said base body components are connected with each other in said bottom region.

13. An adapter group, comprising at least two adapters according to claim 1 which are connected with each other by a connecting element.

14. A centrifuging system, comprising:

a centrifuge bucket;

an adapter according to claim 1 accommodated in said centrifuge bucket; and a sample container.

15. The adapter according to claim 8, wherein said separation joint extends from said opening edge down into said beveled region of said bottom region.

16. The adapter according to claim 12, wherein said base body components are connected with each other in a beveled region of said bottom region.

17. The adapter group according to claim 13, wherein said connecting element comprises a handle.

18. A centrifuge system, comprising:

a centrifuge bucket;

an adapter group according to claim 13 and connected in said centrifuge bucket; and a sample container.

* * * * *